US008446048B2

(12) United States Patent
Butt et al.

(10) Patent No.: US 8,446,048 B2
(45) Date of Patent: May 21, 2013

(54) CONTROLLER FOR A SAFETY SHUT-OFF SYSTEM

(76) Inventors: Marvin Dean Butt, Brookside (CA); Scott Christopher Kelly, Richmond (CA)

( * ) Notice: Subject to any disclaimer, the term of this patent is extended or adjusted under 35 U.S.C. 154(b) by 359 days.

(21) Appl. No.: 12/733,212

(22) PCT Filed: Aug. 18, 2008

(86) PCT No.: PCT/CA2008/001462

§ 371 (c)(1), (2), (4) Date: Apr. 29, 2010

(87) PCT Pub. No.: WO2009/021330

PCT Pub. Date: Feb. 19, 2009

(65) Prior Publication Data

US 2010/0238639 A1 Sep. 23, 2010

Related U.S. Application Data

(60) Provisional application No. 60/956,155, filed on Aug. 16, 2007.

(51) Int. Cl.

| | |
|---|---|
| ***H02B 1/24*** | (2006.01) |
| ***H01H 35/00*** | (2006.01) |
| ***H01H 83/00*** | (2006.01) |

(52) U.S. Cl.
USPC ..... 307/116

(58) Field of Classification Search
USPC ..... 307/116, 117; 340/628; 361/807
See application file for complete search history.

(56) References Cited

U.S. PATENT DOCUMENTS

| | | | | |
|---|---|---|---|---|
| 4,032,286 | A | 6/1977 | Kobayashi et al. | |
| 4,659,909 | A | 4/1987 | Knutson | |
| 5,289,158 | A | 2/1994 | Neves | |
| 5,734,206 | A * | 3/1998 | Keizer et al. | 307/116 |
| 6,025,788 | A | 2/2000 | Diduck | |
| 6,046,441 | A | 4/2000 | Daffron | |
| 6,130,412 | A | 10/2000 | Sizemore | |
| 6,380,852 | B1 * | 4/2002 | Hartman et al. | 340/521 |
| 6,697,617 | B2 * | 2/2004 | Liebenow | 455/425 |

(Continued)

FOREIGN PATENT DOCUMENTS

WO WO03/087640 10/2003

OTHER PUBLICATIONS

International Search Report of the International Searching Authority, mailed Nov. 24, 2008, for corresponding International Application No. PCT/CA2008/001462.

(Continued)

*Primary Examiner* — Carlos Amaya
(74) *Attorney, Agent, or Firm* — Klarquist Sparkman, LLP

(57) ABSTRACT

A controller for a safety shut-off system is taught. The controller is for a system that interrupts a supply of electricity to an electrical appliance upon detecting a trigger. The controller includes a housing having a cover with an electrical socket, which is configured to receive an electrical plug electrically coupled to the appliance. The controller also includes interrupter circuitry contained within the housing, which is electrically coupled to a power supply and to the socket, and which is configured to decouple the power supply from the socket upon receiving a trigger signal. The trigger signal is generated in response to a safety hazard associated with the electrical appliance.

16 Claims, 8 Drawing Sheets

U.S. PATENT DOCUMENTS

| | | | |
|---|---|---|---|
| 6,875,051 | B2 | 4/2005 | Pizak |
| 6,974,936 | B2 | 12/2005 | Yamauchi et al. |
| 7,009,514 | B2 | 3/2006 | Dupeire |
| 7,022,958 | B2 | 4/2006 | Yamauchi et al. |
| 2006/0032932 | A1 | 2/2006 | Bartlett |
| 2006/0044133 | A1 | 3/2006 | Lou |
| 2006/0164253 | A1 | 7/2006 | Harvey et al. |
| 2006/0170542 | A1 | 8/2006 | Schoor |
| 2006/0232431 | A1 | 10/2006 | Shirlee |
| 2007/0155349 | A1 | 7/2007 | Nelson et al. |

OTHER PUBLICATIONS

Written Opinion of the International Searching Authority, mailed Nov. 24, 2008, for corresponding International Application No. PCT/CA2008/001462.

http://www.firedenyer.co.nz/, Fire Preventors Limited, "The Fire Denyer," published May 1, 2006, 12 pages.

* cited by examiner

CONTROLLER FOR A SAFETY SHUT-OFF SYSTEM

CROSS REFERENCE TO RELATED APPLICATIONS

This is the U.S. National Stage of International Application No. PCT/CA2008/001462, filed Aug. 18, 2008, which in turn claims the benefit of U.S. Provisional Application No. 60/956,155, filed Aug. 16, 2007. The provisional application is incorporated herein by reference in its entirety.

FIELD OF THE INVENTION

The present invention relates to a safety shut-off system, and more particularly to a controller for interrupting a supply of electricity to an appliance upon detection of a trigger, such as smoke.

BACKGROUND OF THE INVENTION

Home fires are a serious problem in the United States. The National Fire Protection Association reports that between the years 1999-2002, for example, there were 114,000 reported home fires associated with cooking alone. On average, these fires resulted in 290 deaths and 4,380 injuries annually. Of these fires, approximately two-thirds started with the kitchen range or stove.

Undoubtedly as a result of the severity of the problem of home fires, numerous safety shut-off systems, that attempt to address this problem, have been developed. For example, U.S. Pat. No. 6,130,412 (Sizemore) and U.S. Patent Application 2006/0170542 (Schoor), generally describe systems having a detector for detecting a signal indicative of fire, such as smoke; a switch that connects an appliance, such as an electric range, to an AC power supply; and a controller that opens the switch upon receiving a signal from the detector. These systems also exist in both wired and wireless embodiments. In a wired system the detector is coupled to the controller by a wire; in wireless systems, the coupling between the detector and the controller is usually by means of an RF signal.

Given the need for a solution to the problem of home fires, it is odd that few, if any, of the present systems have been commercially successful. A closer examination of these systems reveals several possible reasons for this. First, the current systems require a level of skill to install that may be beyond the skill level of a typical consumer. Schoor, for example, teaches a system, which, in its wired embodiment, comprises a controller contained within a custom housing that, can optionally be hidden within a wall. A prospective consumer who is interested in a do-it-yourself project may find the prospect of cutting away drywall and having to wire a system too daunting to attempt and consequently avoid purchasing the system. Furthermore, the need for the manufacturer to supply a custom housing for the controller increases manufacturing costs, which costs must be passed on to consumers. The end result is that consumers are presented with a safety shut-off system that is relatively difficult to install, expensive, and possibly do not satisfy building code requirements, all of which are detrimental to success in the marketplace.

Similar problems plague wireless embodiments of safety shut-off systems. Both Schoor and Sizemore, for example, teach wireless safety shut-off systems whose controller is contained within a custom housing interposed between a standard circuit box and the plug of an appliance. As with the wired embodiment discussed above, such a design presents two problems for consumers: first, the housing for the controller is customized, which translates into increased costs for the consumer; second, the housing for the controller is designed to be positioned flush against the outside of a wall, and consequently protrudes from the wall by the thickness of the housing. This prevents appliances connected to the safety shut-off system from sitting flush against the wall. Consequently, the appliances must sit such that there is a gap between the back of the appliances and the wall. As the floor space associated with this gap is not accessible by the consumer, such a result is not an efficient use of floor space. Such an appliance layout is also not particularly aesthetically pleasing, especially for smaller kitchens.

Consequently, there is a need for a controller for a safety shut-off system that is inexpensive to manufacture, easy to install, and that allows for the efficient and aesthetically pleasing use of floor space.

SUMMARY OF THE INVENTION

According to a first aspect of the invention, there is provided a controller for a system that interrupts a supply of electricity to an electrical appliance upon detecting a trigger. The controller includes a housing having a cover with an electrical socket, the socket configured to receive a first electrical plug electrically coupled to the appliance; and interrupter circuitry contained within the housing, electrically coupled to a power supply and to the socket, configured to decouple the power supply from the socket upon receiving a trigger signal, the trigger signal being generated in response to a safety hazard associated with the electrical appliance. The trigger signal may be, for example, a signal from a hazard detector such as a smoke detector. The interrupter circuitry may include, for example, a microcontroller coupled to a relay driver and a relay.

The controller may further include an electrical cord extending from the housing and a second electrical plug electrically coupled to an end of the electrical cord, the interrupter circuitry electrically coupled to the power supply via the electrical cord and second electrical plug.

The interrupter circuitry may be constructed on a printed circuit board and wherein the printed circuit board is configured to circumscribe a portion of the socket that protrudes into the housing such that the interrupter circuitry can fit within a standard circuit box. The printed circuit board may have an opening through which the portion of the socket that protrudes into the housing extends, and the opening may be cruciform.

The trigger signal may be transmitted from a hazard detector either wirelessly or using a wired connection.

The interrupter circuitry can be further configured to decouple the power supply from the socket upon receiving a panic signal, which can be generated in response to a first user input. The first user input may involve a user pressing a panic button, for example.

The interrupter circuitry can be further configured to reconnect the power supply to the socket upon receiving a reset signal, which can be generated in response to a second user input. The second user input may involve a user pressing a reset button, for example.

The first and second user inputs are generated using a common user input device. The common user input device may be a combined panic/reset button, for example.

The user input device may include wireless transmission circuitry configured to wirelessly transmit the panic and reset signals from the common user input device to the interrupter circuitry. Wireless transmission circuitry can include, for example, antennas and transmitters.

When signals are transmitted to the controller wirelessly, at least one of the trigger, panic and reset signals may be encoded and, in such cases, the interrupter circuitry may further include decoder circuitry, which is configured to decode the at least one encoded signal such that the interrupter circuitry responds only to the at least one encoded signal, thereby allowing the controller to properly function when exposed to a plurality of wireless signals.

The controller may also include an alarm communicatively coupled to the interrupter circuitry, which is configured to sound an audible signal when the interrupter circuitry decouples the power supply from the socket.

The trigger signal may be transmitted from a hazard detector powered using a hazard detector battery, the hazard detector including battery power detection circuitry configured to detect a level of charge of the hazard detector battery and to transmit a hazard detector low battery signal to the controller when the level of charge of the hazard detector battery decreases below an acceptable threshold. In such cases, the interrupter circuitry can be further configured to receive the hazard detector low battery signal and to decouple the power supply from the socket upon receiving the hazard detector low battery signal.

The interrupter circuitry may be further configured to decouple the power supply from the socket upon receiving a panic signal and to reconnect the power supply to the socket upon receiving a reset signal, the panic and reset signals being generated in response to user inputs from a user input device powered using a user input device battery, the user input device comprising battery power detection circuitry configured to detect a level of charge of the user input device battery and to transmit a user input device low battery signal to the controller when the level of charge of the user input device battery decreases below an acceptable threshold. In such cases, the interrupter circuitry can be further configured to receive the user input device low battery signal and to decouple the power supply from the socket upon receiving the user input device low battery signal.

The controller may also include an alarm communicatively coupled to the interrupter circuitry, the alarm configured to sound an audible signal when the interrupter circuitry receives either of the user input device low battery signal or the hazard detector low battery signal.

When the interrupter circuitry transitions from an unpowered to a powered state, it may be configured to decouple the power supply from the socket until it receives a reset signal, the reset signal being generated in response to a user input, such as pressing a reset button.

The interrupter circuitry may be further configured to decouple the power supply from the socket upon receiving a lockout signal, which can be generated in response to a first user input from a user input device, and to reconnect the power supply to the socket upon receiving restore power signal, which can be generated in response to a second user input from the user input device. The user input device may be a numeric keypad, the lockout signal is generated following entering of a lockout passcode, and the restore power signal is generated following entering of a power restoring passcode.

A detailed description of an exemplary embodiment of the present invention is given in the following. It is to be understood, however, that the invention is not to be construed as limited to this embodiment. The exemplary embodiment set out below is directed to a safety shut-off system used in a kitchen, but the invention may be applied to other applications involving electrical appliances generally.

BRIEF DESCRIPTION OF THE DRAWINGS

In the accompanying drawings, which illustrate an exemplary embodiment of the present invention.

DETAILED DESCRIPTION OF AN EXEMPLARY EMBODIMENT

Figure 1A:
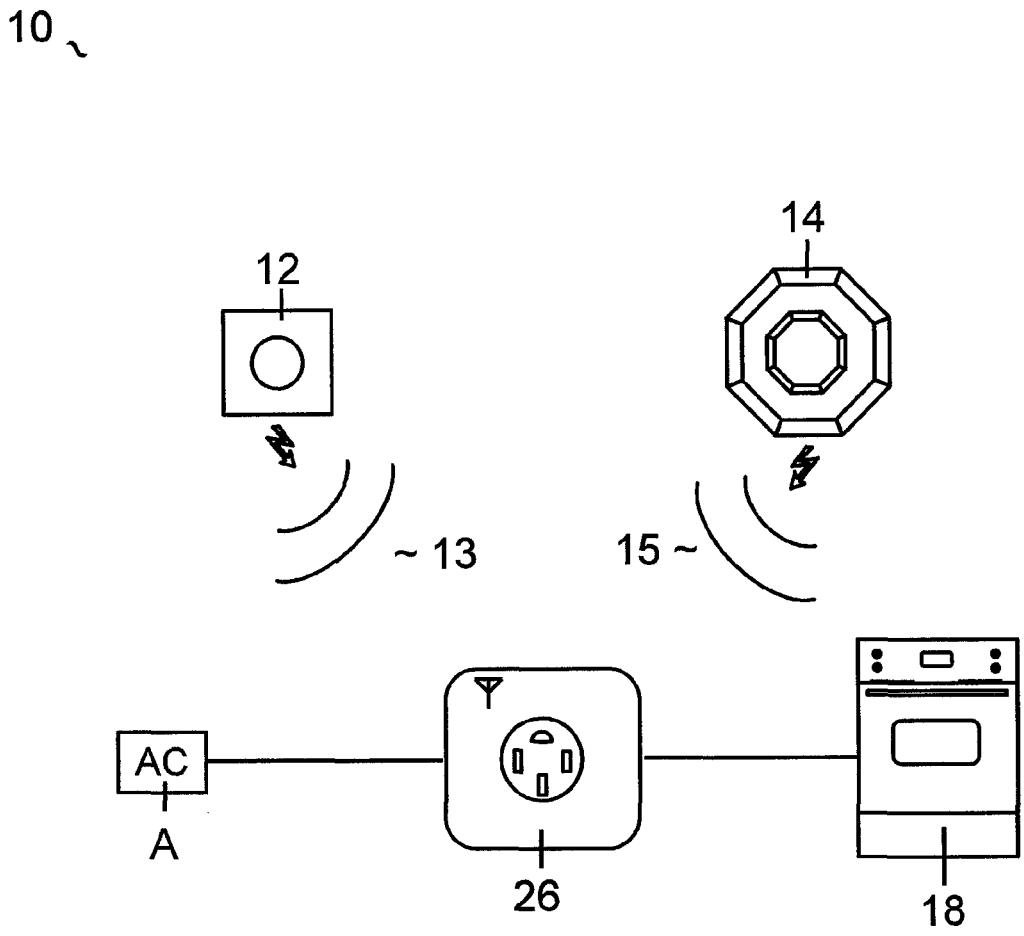
FIGS. 1A and 1B are schematic views of wireless and wired embodiments, respectively, of a safety shut-off system utilizing the controller of the present invention.

According to one embodiment of the invention and referring to FIG. 1A, a safety shut-off system 10 whose components are connected wirelessly is shown. In the embodiment of FIG. 1A, the system 10 comprises a smoke detector 14 and a wireless transmitter housed therein (not shown), a panic/reset button 12 and a wireless transmitter housed therein (not shown), a standard circuit box 26 and a controller 20 housed therein, an AC power source A, and an electric appliance 18. While in this embodiment the use of a smoke detector is taught, other hazard detectors, such as tremor detectors that detect earthquakes, could also be used. During normal operation, the appliance 18 is plugged into the circuit box 26 and the controller 20 allows electricity to be conducted from AC power supply A to the appliance 18. The housing of the controller 20 comprises a standard Leviton™ circuit box, or any other suitable and commercially available circuit box, fits within a wall and is flush with the exterior of the wall. Characteristics of a suitable circuit box include that it should satisfy any applicable building regulatory requirements and should have a front cover that is removable and that allows for easy access to the interior of the box. An exemplary circuit box is a Leviton™ 1279-001 receptacle, which measures 4 11/16" long×4 11/16" wide×2 1/8" deep. Exemplary wireless smoke detectors 14 include the ADEMCO 5806 detector, the SecureLinc (73942) detector, and the Wisdom 433 Mhz Wireless Smoke Detector.

If the detector 14 detects the presence of smoke, then in the wireless embodiment illustrated in FIG. 1 an RF signal 15 is transmitted and is received by the controller 20. Upon receiving the signal, the controller interrupts the AC power supply to the appliance 18 and consequently shuts the appliance 18 off. With the appliance 18 shut off, the energy that would otherwise act as an accelerant for the fire is eliminated, and the progress of the fire is slowed. While the fire is not actively extinguished by the safety shut-off system, by slowing the progress of the fire the system helps to minimize fire damage. In the case of a false alarm, or when the danger posed by the fire has passed, a user can press the panic/reset button 12, which will transmit an RF signal 13 to the controller 20, and the controller 20 will restore the AC power supply to the appliance 18.

Figure 1B:
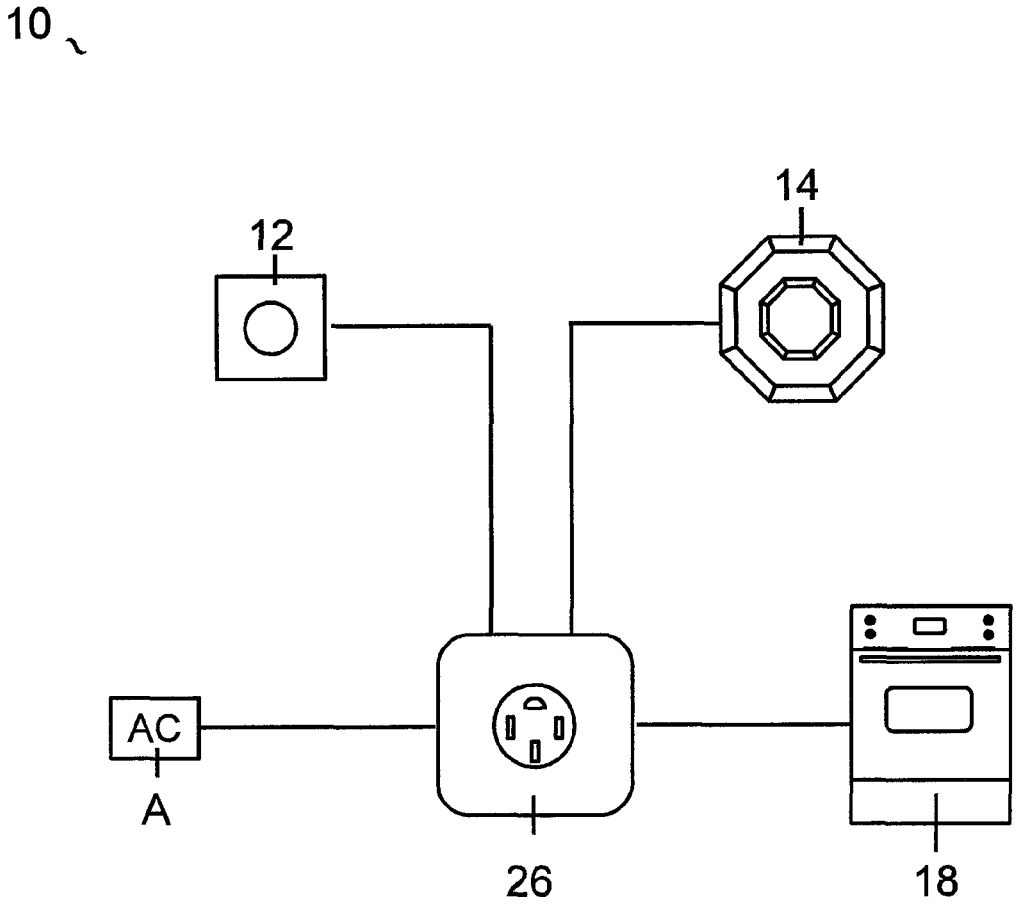

Alternatively, in the embodiment shown in FIG. 1B, the controller 20, detector 14, and panic/reset button 12 are all wired together. The wiring takes the place of the RF signals 13, 15 illustrated in FIG. 1A. The wiring can be performed by the user alone, by a professional in a completed home, or by a professional during the construction of the home.

Figure 2:
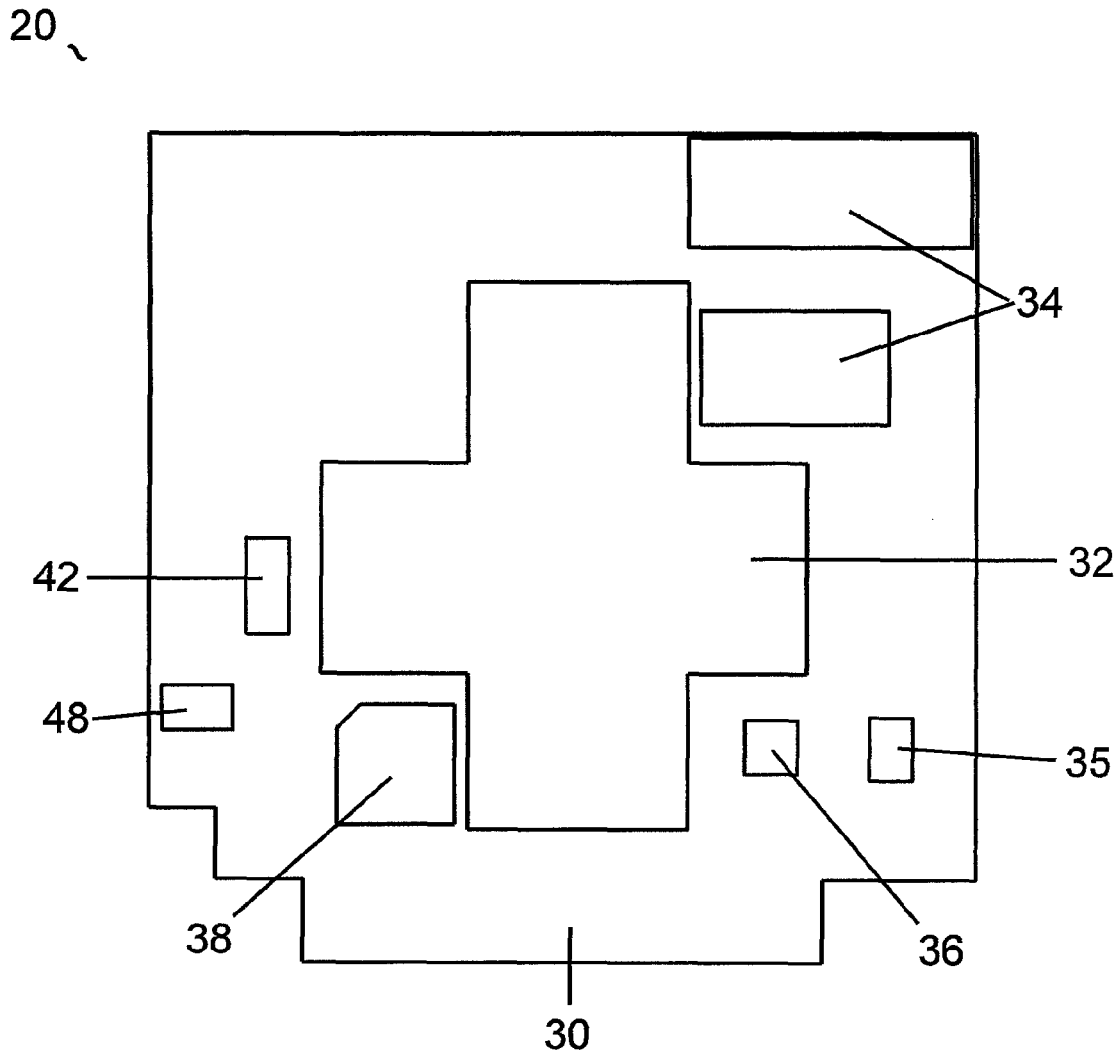
FIG. 2 is a plan view of one side of a printed circuit board ("PCB"), adapted to fit into a standard circuit box, comprising the controller.
Figure 3:
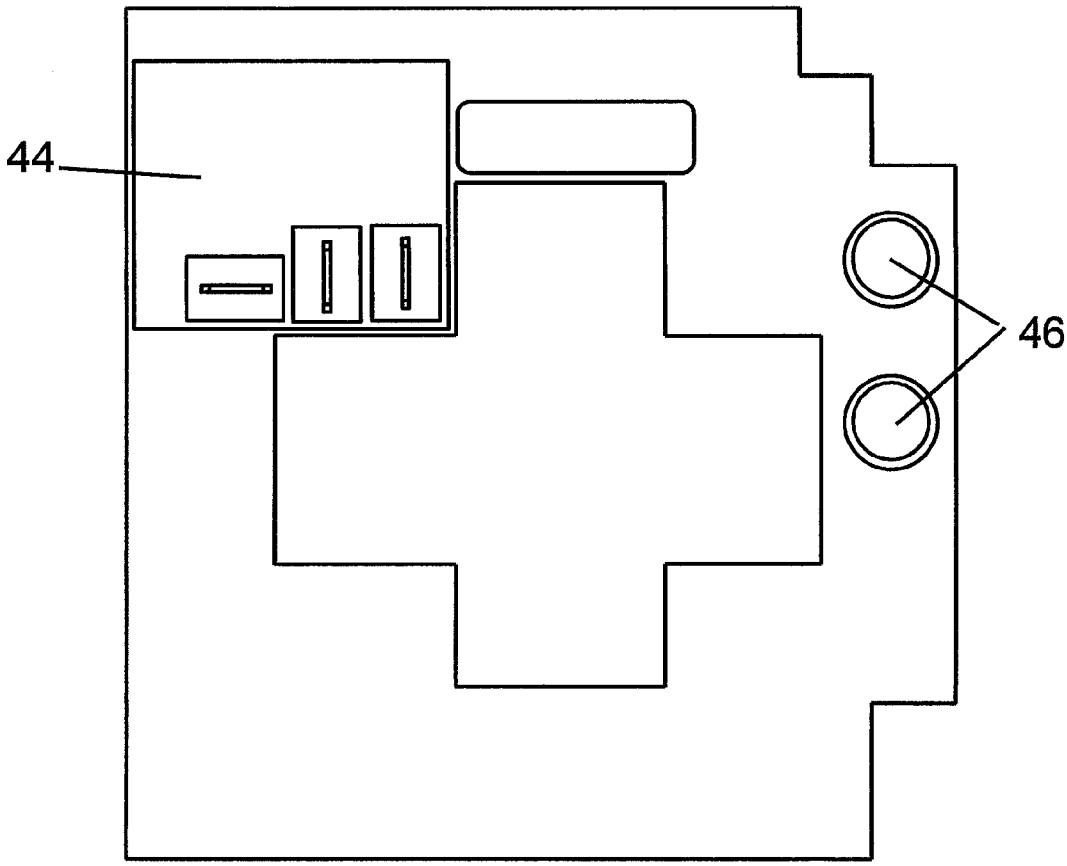
FIG. 3 is a plan view of the second side of the PCB shown in FIG. 2.

Referring now to FIGS. 2 and 3, there are shown plan views of the PCB 30 that comprises the controller 20. At the centre of the PCB 30 is a cruciform hole 32, which is constructed so that it fits snugly around the inwardly protruding socket portion of a standard circuit housing 26. The embodiment of the PCB 30 shown in FIGS. 2 and 3 is for use in a wireless embodiment of the safety shut-off system 10, and thus comprises the planar antenna and RF receiver combination 34, which receive the RF signals 13, 15 sent from the transmitter 16 and the panic/reset button 12. Following receipt of the signal 13, 15 by the antenna and receiver 34, the signal is decoded using an RF decoder 35. The use of the decoder 35 allows multiple wireless units to operate in proximity to each other, as the signal 15 received from one detector 14 will only interrupt the AC power supply of the particular controller 20 associated with that specific detector 14. Similarly, the signal 13 received from one panic/reset button 12 will only restore the AC power supply of the particular controller 20 associated with that specific panic/reset button 12. Thus, two instances of the wireless embodiment of the present invention could be purchased and installed in adjacent apartments without concerns as to interference between the systems. That is, a signal from the detector in one apartment will not trigger an interruption in the AC power supply of the adjacent apartment.

Typical components that can be used to manufacture transmitting circuits include the Linx Technologies™ ANT-418-SP Antenna, TXM-418-LR Transmitter, and LICAL-ENC-MS001 Encoder; typical components that can be used to manufacture receiver circuits include the Linx Technologies™ ANT-418-SP Antenna, RXM-418-LR Receiver, and LICAL-ENC-MS001 Decoder. Other electronic components suitable for manufacturing RF transmitter and receiving circuits could also be used.

Following processing of the signal by the decoder 35, the signal is transmitted to a microcontroller 36, which is connected to both a relay driver 42 and a speaker 38. The microcontroller 36 is programmed with firmware that operates according to the flowchart of FIG. 7. If, pursuant to the algorithm implemented in the firmware, power to the appliance 18 needs to be interrupted, or if the panic/reset button 12 is pressed indicating an emergency notwithstanding smoke not having been detected by the detector 14, the microcontroller 36 sends a signal to the relay driver 42. The relay driver 42 consequently opens a relay 44 and interrupts the AC power supply to the appliance 18. If, pursuant to the algorithm implemented in the firmware, power should be restored to the appliance 18, the appropriate signal is sent to relay driver 42, which consequently closes the relay 44 and restores power. At all times the AC power supply is being interrupted, the microcontroller 36 sends a signal to the speaker 38 to sound an alarm. The alarm generated by the speaker 38 is especially useful when the alarm generated by the detector 14 has been discontinued but power has not as yet been restored by the controller 20 to the appliance 18. In this case, the alarm alerts the user to the fact that power to the appliance 18 has not yet been restored, and that the panic/reset button 12 needs to be pressed. In the case of a system malfunction in which the relay 44 has been inadvertently opened in the absence of the signal 15 from the detector 14 or the signal 13 from the panic/reset button 12, then the alarm will alert the user not to the fact that there is a potentially dangerous fire situation, but to the fact that power to the appliance 18 has been erroneously interrupted. All electronic components mounted on the PCB 30 that require DC power are supplied with this power from the power supply of the PCB 30, comprising capacitors 46 and a bridge rectifier 48. The bridge rectifier can be, for example, a DF02M or a DB103 integrated circuit.

Figure 4:
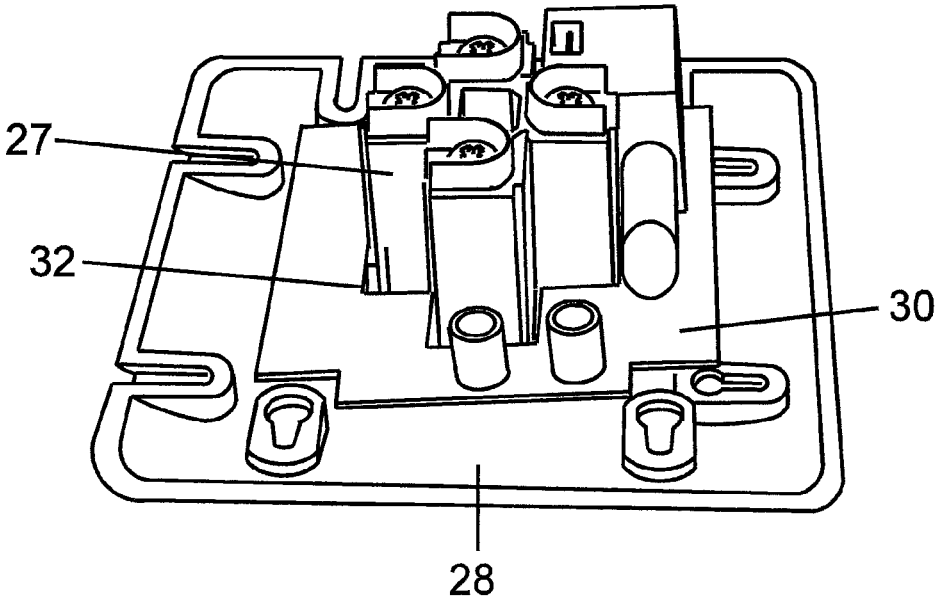
FIG. 4 is a perspective view of the PCB fitted over the interior side of a front plate of the standard circuit box.
Figure 5:
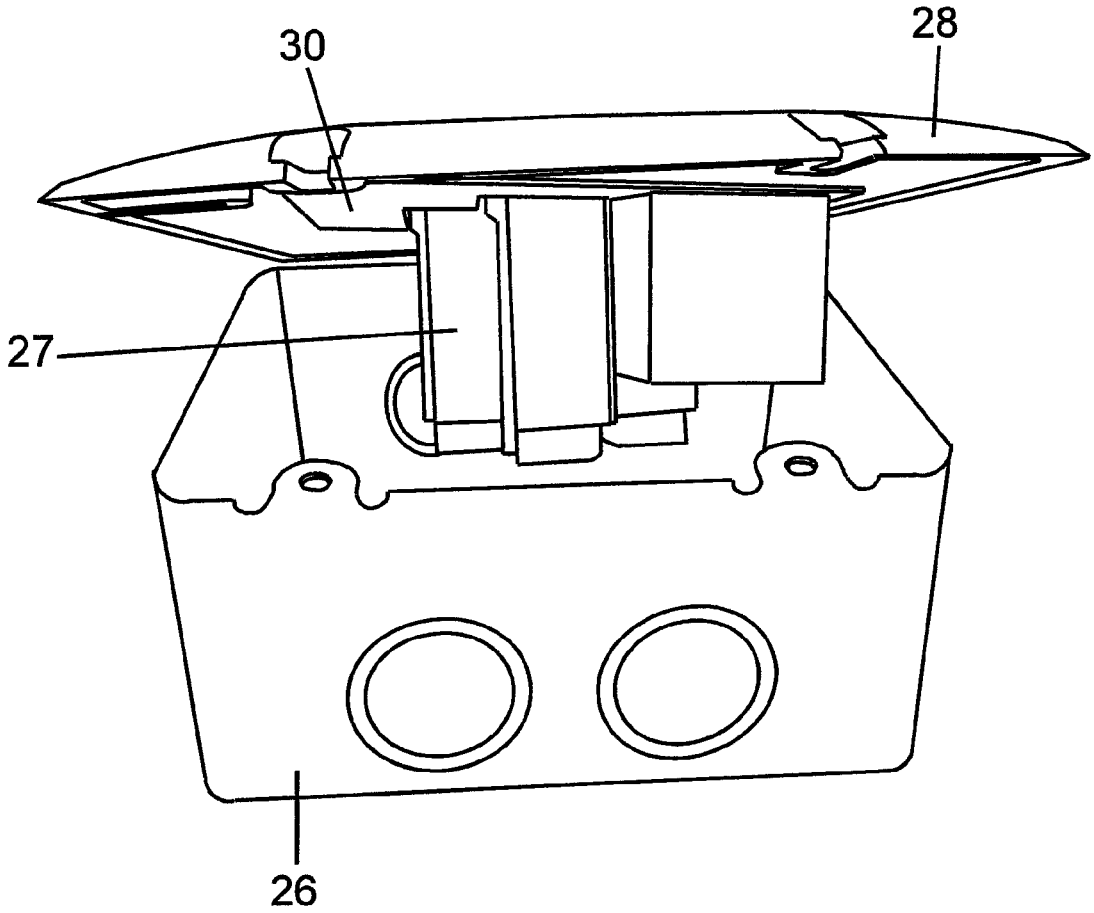
FIG. 5 is a perspective view of the PCB and front plate as shown in FIG. 4 positioned such that they are partially contained within the standard circuit box.

Referring now to FIGS. 4 and 5, there is shown the PCB 30 fitted snugly on the interior side of the front plate 28 of the standard circuit housing 26. FIG. 4 clearly shows the cruciform hole 32 filled with the inwardly extending projections 27 of the front plate 28 that accommodate the prongs of an appliance plug. Clearly, the PCB 30 has to be specially adapted by cutting the cruciform hole 32 such that both the projections 27 and PCB 30 can be housed within the standard circuit housing 26.

Figure 6:
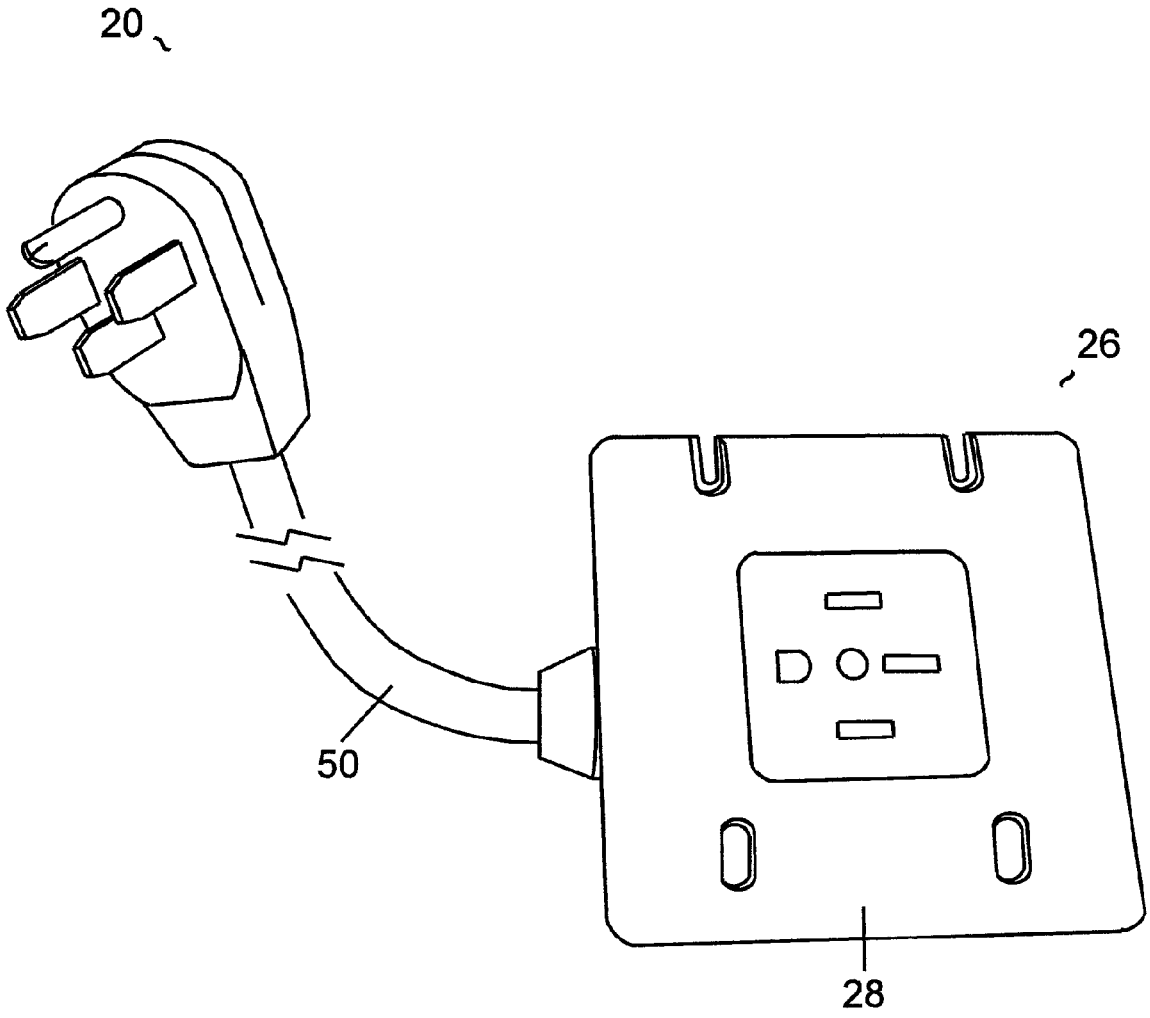
FIG. 6 is a perspective view of the circuit box in an embodiment in which it is not designed to be flush mounted within a wall.

FIG. 6 is an embodiment of the controller 20 that can be connected to the detector 14 and the panic/reset button 12 either wired or wirelessly and that is not designed to be flush mounted on the interior of the wall. In this embodiment, the relay 44 of the controller 20 is coupled to a cord 50, one end of which is adapted to be inserted into a standard power outlet. Even though the controller 20 is not designed to be flush mounted within a wall, the benefits of the flush mounted embodiment are retained. First, as the standard circuit housing 26 is still used to house the PCB 30, manufacturing costs remain lower than they would otherwise be if a custom made housing were instead to be used. This cost savings can be transferred to the user. Second, the thickness of the standard circuit housing 26, as measured from the front plate 28 to the counterpart back face of the housing 26 is low enough such that, generally, the housing 26 can fit inconspicuously either under or to the side of the appliance 18. Thus, the appliance 18 can still be positioned such that it sits flush against the wall, which both functionally and aesthetically benefits the user.

Figure 7:
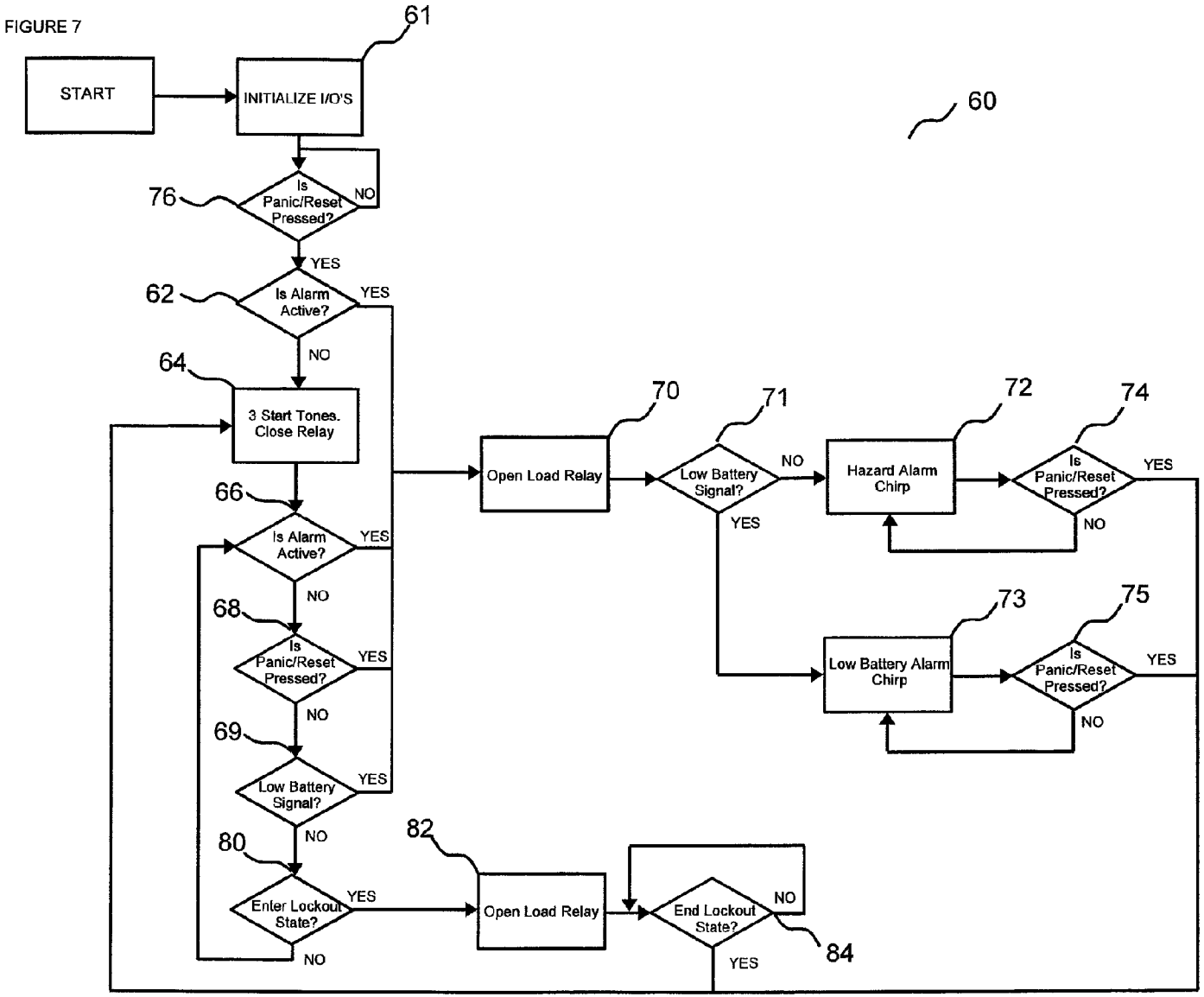
FIG. 7 is a flow chart illustrating the functionality of the controller.

Finally, referring now to FIG. 7, a flow chart 60 of the algorithm implemented in the firmware of the microcontroller 36 is displayed. By default, upon starting up, the relay 44 is open and no power is supplied to the appliance 18. Following initialization (block 61), the microcontroller 36 can first optionally wait until the panic/reset button 12 is pressed before proceeding to close the relay 44 (block 76). A benefit of waiting for the user to press the panic/reset button 12 before closing the relay 44 (see block 64, discussed below) is that if power to the appliance 18 has previously been interrupted as a result of a power failure, the user may have left the appliance "on" forgetting that, when the power failure ends and power is restored some time later, the appliance 18 could be untended and therefore could create a fire hazard. By requiring the user to press the panic/reset button 12 upon the system starting up, power will be restored to the appliance 18 only at the user's explicit request, thereby alleviating the risk of a fire hazard.

Following the user's pressing the panic/reset button 12, the microcontroller 36 checks to see whether the smoke alarm 14 is active (block 62). If not, the microcontroller 36 sends a signal to the relay driver 42 to close the relay 44 (block 64), and enters a loop during which time it simply waits for either the signal 15 indicating that the smoke alarm 14 has detected smoke or the signal 13 indicating that the panic/reset button 12 has been pressed (blocks 66 and 68). Additionally, one or both of the smoke alarm 14 and the panic/reset button 12 may be powered using batteries. In such cases, if the remaining battery power of the smoke alarm 14 or the panic/reset button 12 becomes dangerously low, a signal (the "low-battery signal") can be transmitted from the smoke alarm 14 or the panic/reset button 12 to the microcontroller 36, the receipt of which indicates that the system is operating in a "low-battery state". The microcontroller 36 can be configured to periodically check to see if it has received the low-battery signal (block 69).

If the alarm 14 is active, the panic/reset button 12 is pressed, the microcontroller 36 has received the low-battery signal, or if signals 13, 15 are detected immediately following initialization, then a signal is sent to open the relay 44 (block 70) to interrupt the AC power supply to the appliance 18. If the relay 44 is open for a reason other than having received the low-battery signal (determined at block 71), then the microcontroller 36 sounds a "hazard alarm" that indicates to the user that power has been interrupted because of a potentially dangerous condition (e.g.: the presence of smoke or because someone has pressed the panic/reset button 12) (block 72). The relay 44 remains open until the panic/reset button 12 is pressed (block 74), following which the microcontroller 36 closes the relay 44 and again enters the loop during which it waits for the smoke detector 14 to detect smoke, for the panic/reset button 12 to be pressed, for the low-battery signal, or for the system to enter a lockout state, as described below (blocks 66, 68, 69 and 80). If the relay 44 is open because the system is operating in the low-battery state (determined at block 71), then the microcontroller 36 sounds a "low battery alarm" (block 73) that audibly informs the user that the microcontroller 36 has interrupted the power supply because the system is operating in the low-battery state as opposed to because a hazard has been detected. Following replacement of the necessary batteries, the user can press the panic/reset button 12 (block 75) to reset the system. In addition to automatically interrupting the supply of electricity to the appliance 18 if smoke is detected, this functionality allows the user to manually interrupt the supply for any reason whatsoever, including those unrelated to a kitchen fire (e.g. an earthquake). According to an alternative embodiment (not illustrated), the microcontroller 36 may be configured to continue to supply electricity to the appliance 18 upon detection of the low-battery state, and may only sound the low battery alarm when in such a state as opposed to also interrupting power to the appliance 18. Such a configuration may be more convenient to users who could prefer to replace batteries at a later time and who do not want to deprived of use of their appliance 18 in the meantime.

According to another embodiment of the invention and referring specifically to blocks 80, 82 and 84 of FIG. 7, in addition to the smoke alarm 14, the panic/reset button 12, and the controller 20, the safety shut-off system may further include a numeric keypad (not shown) that can allow the user to enter a user-selected passcode (the "lockout passcode") that can interrupt power to the appliance 18 until another passcode (the "power restoring passcode") is entered. The lockout passcode and the power restoring passcode can be the same. Entering the lockout passcode results in the safety shut-off system entering a "lockout state"; entering the power restoring passcode ends the lockout state. At block 80 in FIG. 7, the microcontroller 36 checks to see if it has received a signal from the numeric keypad indicating that the system is in the lockout state. If so, then the microcontroller 36 sends a signal to open the relay 44 (block 82) and waits for the user to enter the power restoring passcode, thereby signaling the end of the lockout state (block 84). When the lockout state is over, the relay 44 is closed and power is restored to the appliance 18 (block 64). The user may want to interrupt power to the appliance 18 even when no hazard condition is present as a preventative measure. For example, the user may be leaving young children alone with the appliance 18 for some time, in which case interrupting power to the appliance 18 using the lockout passcode can eliminate the possibility that the children will play with the appliance 18 and create a fire hazard. Exemplary keypads that can be used to implement this embodiment include the Chamberlain Clicker Keypad #KLIK2U, the Genie GWKP-BL Wireless Keypad, and the Moore-O-Matic Garage Door Opener MegaCode Wireless Keypad MDTK.

Benefits of the aforedescribed embodiments arise from the fact that a standard circuit box, such as those manufactured by the Leviton family of companies, can be used for both wireless and wired embodiments of the invention. This results in lower manufacturing costs, as the same housing can be used for both wireless and wired embodiments of the controller and the housing is inexpensively available commercially as an off-the-shelf component, thus lowering its price. Additionally, when installing the controller, a consumer does not need to cut a hole in dry wall, but instead can simply swap an existing standard circuit housing for the same type of housing containing the controller. Both benefits reduce the time, effort, and money that need be expended by consumers, and consequently increase the likelihood that consumers will adopt the invention.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the appended claims.

The invention claimed is:

1. A controller interrupting a supply of electricity to an electrical appliance, comprising:

(a) a housing having a cover carrying an electrical socket, the socket configured to receive a first electrical plug electrically coupled to the appliance; and (b) interrupter circuitry enclosed within the housing, the interrupter circuitry electrically coupled between a power supply and the socket, for decoupling the power supply from the socket upon receiving a trigger signal, the trigger signal being generated in response to a safety hazard associated with the electrical appliance, wherein the interrupter circuitry is constructed on a printed circuit board and wherein the printed circuit board is configured to circumscribe a portion of the socket that protrudes into the housing such that the interrupter circuitry can be enclosed within a standard circuit box, and wherein the printed circuit board comprises an aperture through which the portion of the socket that protrudes into the housing extends.

2. A controller as claimed in claim 1 further comprising an electrical cord extending from the housing and a second electrical plug electrically coupled to an end of the electrical cord, the interrupter circuitry electrically coupled to the power supply via the electrical cord and second electrical plug.

3. A controller claimed in claim 1 wherein the aperture is cruciform.

4. A controller as claimed in claim 3 further comprising an alarm communicatively coupled to the interrupter circuitry, the alarm configured to sound an audible signal when the interrupter circuitry decouples the power supply from the socket.

5. A controller as claimed in claim 1 wherein the trigger signal is transmitted from a hazard detector, the hazard detector comprising wireless transmission circuitry configured to wirelessly transmit the trigger signal to the interrupter circuitry.

6. A controller as claimed in claim 5 wherein the interrupter circuitry is further configured to decouple the power supply from the socket upon receiving a panic signal, the panic signal being generated in response to a first user input.

7. A controller as claimed in claim 6 wherein the interrupter circuit is further configured to reconnect the power supply to the socket upon receiving a reset signal, the reset signal being generated in response to a second user input.

8. A controller as claimed in claim 7 wherein the first and second user inputs are generated using a common user input device.

9. A controller as claimed in claim 8 wherein the user input device comprises wireless transmission circuitry configured to wirelessly transmit the panic and reset signals from the common user input device to the interrupter circuitry.

10. A controller as claimed in claim 9 wherein at least one of the trigger, panic and reset signals are encoded and wherein the interrupter circuitry further comprises decoder circuitry, the decoder circuitry configured to decode the at least one encoded signal such that the interrupter circuitry responds only to the at least one encoded signal, thereby allowing the controller to properly function when exposed to a plurality of wireless signals.

11. A controller as claimed in claim 1 wherein (a) the trigger signal is transmitted from a hazard detector powered using a hazard detector battery, the hazard detector comprising battery power detection circuitry configured to detect a level of charge of the hazard detector battery and to transmit a hazard detector low battery signal to the controller when the level of charge of the hazard detector battery decreases below an acceptable threshold; and (b) the interrupter circuitry is further configured to receive the hazard detector low battery signal and to decouple the power supply from the socket upon receiving the hazard detector low battery signal.

12. A controller as claimed in claim 11 wherein the interrupter circuitry is further configured:

(a) to decouple the power supply from the socket upon receiving a manually activated panic signal and to reconnect the power supply to the socket upon receiving a reset signal, the panic and reset signals being generated in response to user inputs from a user input device powered using a user input device battery, the user input device comprising battery power detection circuitry configured to detect a level of charge of the user input device battery and to transmit a user input device low battery signal to the controller when the level of charge of the user input device battery decreases below an acceptable threshold; and (b) to receive the user input device low battery signal and to decouple the power supply from the socket upon receiving the user input device low battery signal.

13. A controller as claimed in claim 11 further comprising an alarm communicatively coupled to the interrupter circuitry, the alarm configured to sound an audible signal when the interrupter circuitry receives either of the user input device low battery signal or the hazard detector low battery signal.

14. A controller as claimed in claim 1 wherein the interrupter circuitry upon transitioning from an unpowered to a powered state is configured to decouple the power supply from the socket until receiving a reset signal, the reset signal being generated in response to a user input.

15. A controller as claimed in claim 1 wherein the interrupter circuitry is further configured to decouple the power supply from the socket upon receiving a lockout signal, the lockout signal being generated in response to a first user input from a user input device, and to reconnect the power supply to the socket upon receiving restore power signal, the restore power signal being generated in response to a second user input from the user input device.

16. A controller as claimed in claim 15 wherein the user input device is a numeric keypad, the lockout signal is generated following entering of a lockout passcode, and the restore power signal is generated following entering of a power restoring passcode.

* * * * *